United States Patent [19]

Hubbard et al.

[11] Patent Number: 4,496,383

Date of Patent: Jan. 29, 1985

[54] PRODUCTION OF NITROGEN FROM AIR

[75] Inventors: Colin Hubbard, Manchester; David I. Limb; Melvyn Duckett, both of Cheshire, all of England

[73] Assignee: Petrocarbon Developments Limited, Manchester, England

[21] Appl. No.: 491,024

[22] Filed: May 3, 1983

[30] Foreign Application Priority Data

May 11, 1982 [GB] United Kingdom ..... 82/13605

[51] Int. Cl.[3] ..... F25J 3/02; F25J 3/04

[52] U.S. Cl. ..... 62/31; 62/39

[58] Field of Search ..... 62/38, 39, 34, 31, 9, 62/11, 24, 32, 42

[56] References Cited

U.S. PATENT DOCUMENTS 3,756,035 9/1973 Yearout ..... 62/31

*Primary Examiner*—Frank Sever

*Attorney, Agent, or Firm*—Browdy and Neimark

[57] ABSTRACT

In the single column process for the recovery of nitrogen from air wherein reflux for the distillation is provided by condensing a first portion of the overhead stream by indirect heat exchange in a reflux condenser with oxygen-rich liquid from the bottom of the column which has been subjected to a first expansion to an intermediate pressure, refrigeration for the process is provided by work expanding evaporated oxygen-rich liquid from the reflux condenser, and prior to said first expansion, the oxygen-rich liquid recovered from the bottom of the column is sub-cooled by indirect heat exchange in a sub-cooler with the work-expanded evaporated oxygen-rich liquid, nitrogen recovery is increased by work expanding the evaporated oxygen-rich liquid at a temperature not substantially greater than that at which it is recovered from the reflux condenser or by first passing it through said sub-cooler at a temperature not substantially greater than that at which it is recovered from the reflux condenser and thereafter work-expanding it at a temperature not substantially greater than that at which it is recovered from the sub-cooler, and feeding the work-expanded evaporated oxygen-rich liquid directly to the sub-cooler.

3 Claims, 2 Drawing Figures

PRODUCTION OF NITROGEN FROM AIR

Figure 1:
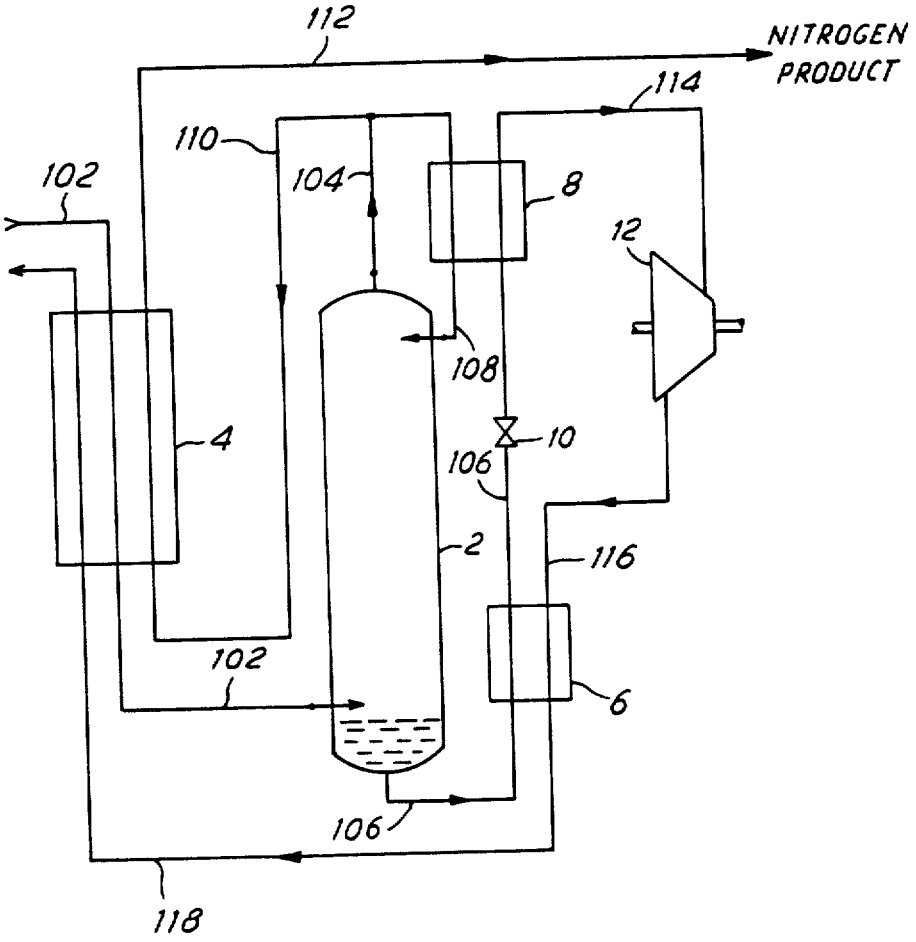

This invention relates to the production of nitrogen from air and is particularly concerned with improvements in the process known as single column cryogenic air separation which is preferred for the production of high purity nitrogen; that is, nitrogen having a purity of at least 98% and generally an oxygen content not exceeding typically 10 ppm.

In one process known for the production of high purity nitrogen by cryogenic air separation, compressed air is cooled to a temperature close to its dew point, and distilled to produce an overhead stream of high purity nitrogen and an oxygen-rich liquid at the bottom. Reflux for the distillation is supplied by condensing a portion of the nitrogen recovered overhead by indirect heat exchange with evaporating oxygen-rich liquid from the column bottom after the latter has been expanded to an intermediate pressure by Joule-Thomson expansion. Refrigeration for the process is provided by work expanding the evaporated oxygen-rich liquid recovered from the reflux condenser after it has been superheated by indirect heat exchange with the feed to the distillation column, and the cooling of the compressed air is effected by passing it in indirect heat exchange with the work-expanded oxygen-rich stream and the overhead product stream.

It is known that a marginal improvement in the amount of nitrogen produced can be obtained by sub-cooling the oxygen-rich bottoms product, prior to subjecting it to the Joule-Thomson expansion, by heat exchange with the work expanded oxygen-rich stream. In an alternative proposal, this sub-cooling is effected by heat exchange with the evaporated oxygen-rich stream as recovered from the reflux condenser and prior to work expanding it. However, with the very large nitrogen plants now required e.g. for injecting nitrogen into oil wells to enhance oil recovery, and with the high cost of energy, still further improvements in nitrogen recovery are desired.

It has now been found that a further valuable increase in the recovery of nitrogen from single column cryogenic air separation plants of the kind described above may be achieved by feeding the oxygen-rich stream recovered from the reflux condenser to the work-expansion step, either directly or after first using it to sub-cool the oxygen-rich bottom product from the distillation column, and passing the work-expanded stream directly through the sub-cooler.

Thus, in accordance with the present invention, a method is provided for the recovery of nitrogen from air in which (i) compressed air is cooled and distilled in a single column to produce a nitrogen-rich stream overhead and an oxygen-rich liquid at the bottom, (ii) reflux for the distillation is provided by condensing a first portion of the overhead stream by indirect heat exchange in a reflux condenser with oxygen-rich liquid from the bottom of the column which has been expanded to an intermediate pressure, (iii) refrigeration for the process is provided by work expanding evaporated oxygen-rich liquid from the reflux condenser, (iv) prior to the expansion of step (ii), the oxygen-rich liquid recovered from the bottom of the column is sub-cooled by indirect heat exchange in a sub-cooler with work-expanded evaporated oxygen-rich liquid from step (iii), (v) the compressed air feed to the distillation is cooled by indirect heat exchange with a second portion of the overhead stream from the distillation which is thereafter recovered as product, and with work-expanded evaporated oxygen-rich liquid recovered from the sub-cooler, (vi) the evaporated oxygen-rich liquid recovered from the reflux condenser which is work-expanded in accordance with step (iii) is work expanded at a temperature not substantially greater than that at which it is recovered from the reflux condenser or is passed first through said sub-cooler which it enters at a temperature not substantially greater than that at which it is recovered from the reflux condenser and is thereafter work-expanded at a temperature not substantially greater than that at which it is recovered from the sub-cooler, and (vii) the work-expanded evaporated oxygen-rich liquid which is passed through said sub-cooler in accordance with step (iv) enters said sub-cooler at a temperature not substantially greater than that to which it is lowered by said work-expansion.

By means of steps (vi) and (vii) the oxygen-rich liquid recovered from the bottom of the column may be sub-cooled to a lower temperature than hitherto, thereby reducing or eliminating any flash that may otherwise occur when this liquid is expanded to the intermediate pressure prior to being employed as the coolant in the reflux condenser. As a result, more cold may be made available from the evaporation of this liquid in the reflux condenser and hence more liquid reflux can pass down the column per unit of oxygen-rich liquid leaving the column base. It is thus possible to obtain a given reflux flow with a smaller flow of oxygen-rich liquid through the reflux condenser and the amount of nitrogen product obtainable from a given intake of atmospheric air can be increased by as much as up to 2% or possibly more, which is a valuable increase in plants employed for the production of nitrogen for injecting into oil wells to enhance the recovery of oil, and which can produce 400–800 tonnes per day of nitrogen.

In the process of the present invention the evaporated oxygen-rich liquid tends to be fed to the expansion engine as a saturated vapour so that some condensation occurs during the work expansion, and indeed it is preferred to operate the process to achieve this. The kind of engine, e.g. expansion turbine, employed for the work expansion should be chosen accordingly.

For maximum benefit, it is preferred that the evaporated oxygen-rich stream recovered from the reflux condenser is passed directly to the work-expansion step or alternatively directly to the sub-cooler and thence directly to said work-expansion step, and that the work-expanded stream is passed directly to the sub-cooler. While the invention does not exclude the possibility of the temperature of the evaporated oxygen-rich stream being increased slightly prior to its delivery to the sub-cooler or to the work-expansion step or, in the former case, the temperature of the evaporated oxygen-rich stream recovered from the sub-cooler being increased slightly prior to its delivery to the work-expansion step, or the temperature of the work-expanded stream being increased slightly prior to its delivery to the sub-cooler, the increase in nitrogen recovery achieved by the process of invention would be reduced by so doing.

Figure 2:
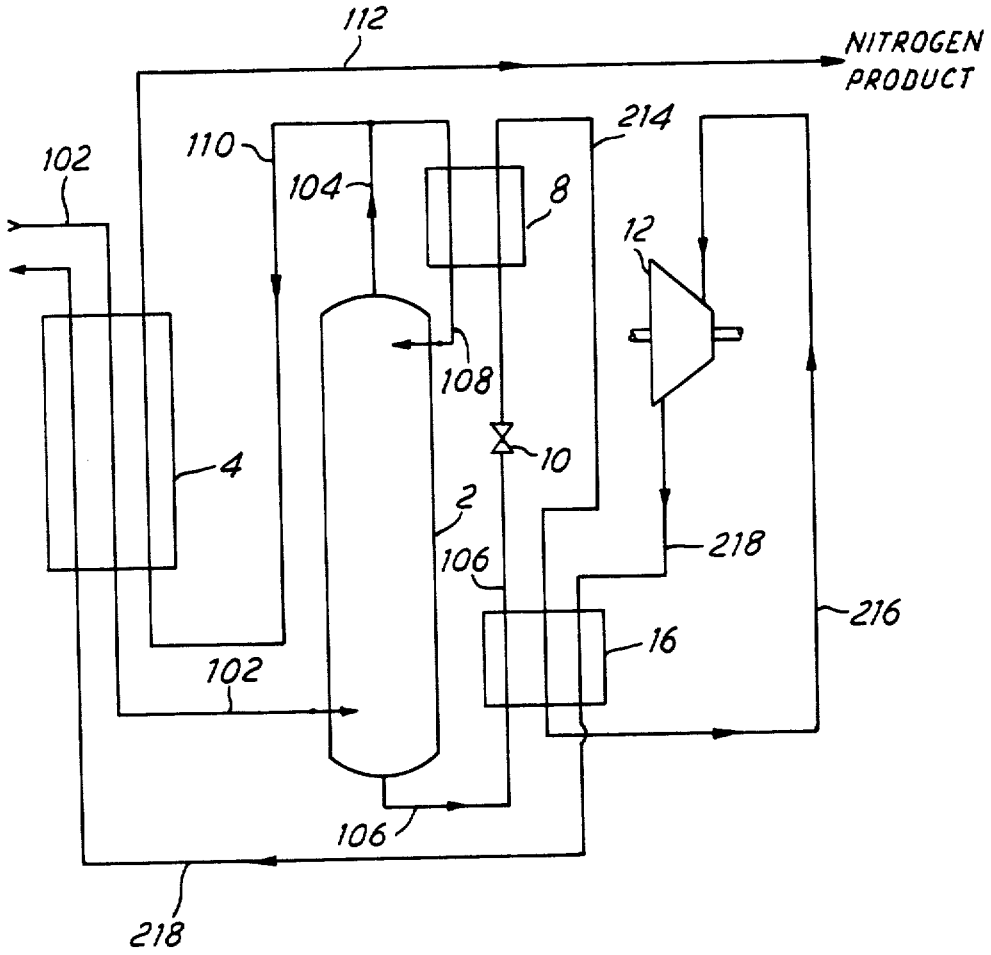

The invention will now be described in greater detail with reference to two embodiments and with the aid of the accompanying drawings in which FIG. 1 illustrates a nitrogen plant in which the evaporated oxygen-rich liquid recovered from the reflux condenser is passed direct to the work-expansion step and thereafter to a sub-cooler, and FIG. 2 illustrates a nitrogen plant in which the evaporated oxygen-rich liquid recovered from the reflux condenser is passed directly to a sub-cooler, in indirect heat exchange with the oxygen-rich liquid leaving the bottom of the column, and then to the work-expansion step and back through the sub-cooler.

In FIGS. 1, 2 is a distillation column, 4 is a heat exchanger, 6 is a sub-cooler, 8 is a reflux condenser, 10 is an expansion valve and 12 is an expansion turbine.

The air to be processed is first compressed, e.g. to a suitable pressure which will usually be in the range 4 to 10 bar, and generally 5 to 8 bar, e.g. about 6 bar. As the refrigeration for the process is supplied by the work expansion of the evaporated oxygen-rich liquid and the heat loss from the plant relative to its capacity tends to decrease with increase in the size of the plant, the pressure to which the air must be compressed will tend to decrease with increase in the size of the plant. After compression, it is treated in any suitable and well-known manner to remove components such as moisture and carbon dioxide that would solidify at the temperatures employed for the cryogenic separation. It is then passed via pipeline 102 to the main heat-exchanger 4 where it is cooled by indirect heat exchange with nitrogen product and with an oxygen-enriched stream which has been recovered from the bottom of distillation column and thereafter treated in a manner described below. The temperature to which it is cooled will be close to the dew point of the air at the pressure to which it has been compressed. In general it will be slightly below the dew point but the feed can be supplied to the column in a slightly superheated form if the refrigeration produced by work-expanding the evaporated oxygen-rich liquid is large enough. For the range of the pressures mentioned above, the temperature to which the feed is cooled will generally be in the range 95 to 105 K. The cooled air is then fed to distillation column 2, being injected at a location near the bottom of the column. A gaseous nitrogen-rich stream is recovered overhead in line 104 and an oxygen-enriched liquid stream is recovered from the bottom of the column in line 106. Part of the overhead product is condensed in reflux condenser 8 in a manner described below and returned to the column through line 108 to provide the reflux. Another part, which may be the remainder, is recovered in line 110, passed back through heat exchanger 4 where it is employed to cool the incoming compressed air, and recovered as nitrogen product in line 112. Some of the overhead product, however, can be recovered as liquid, if desired, by passing through the reflux condenser more of the overhead than is required for the reflux and withdrawing the remainder from line 108 through a liquid nitrogen product line not shown.

The oxygen-enriched liquid recovered from the bottom of the column is cooled in sub-cooler 6, expanded in expansion valve 10 to an intermediate pressure, which is chosen such that the dew point of the expanded product is sufficiently below that of the overhead stream from the column that it will evaporate in the reflux condenser, and is generally about 2 bar below the pressure of the feed to the column, and passed to reflux exchanger 8 where it evaporates in indirect heat exchange with overhead nitrogen gas from the column in line 108 thereby condensing the gas and providing the column reflux (and any liquid nitrogen product that may be desired). The oxygen-rich stream recovered from the reflux condenser, which will be in the form of a saturated vapour, is then passed by line 114 direct to the inlet of expansion turbine 12. Its temperature at the expansion turbine inlet will thus be substantially the same as that at which it is recovered from the reflux condenser 8. In the expansion turbine, it is expanded to about atmospheric pressure and thereby cooled. The cooled work-expanded stream so obtained is then passed via line 116 direct to sub-cooler 6, where it sub-cools the oxygen-rich liquid stream in line 106, and thence via line 118 through heat exchanger 4 where it assists in cooling the incoming feed to the distillation column.

As the oxygen-rich stream recovered from the reflux condenser in line 114 is passed direct to the inlet of the expansion turbine without first being passed through heat exchanger 4, as was previously done, and because it is cooled on work expansion, the temperature at which it is supplied to the sub-cooler 6 is actually below that at which it is recovered from the reflux condenser 8. Accordingly a greater degree of cooling of the oxygen-rich stream recovered from the column bottom in line 106 can be effected in sub-cooler 6. Moreover, as the stream supplied to the turbine is a saturated vapour, some condensation occurs in the turbine and the stream in line 116 is a vapour/liquid mixture. Thus, further cold is made available in the sub-cooler by evaporation of the liquid component. The overall effect is the reduction or elimination of flash in expansion valve 10 and a consequent increase in the cold available from evaporation of the expanded oxygen-enriched liquid in the reflux condenser 8 thereby reducing the liquid flow rate required in line 106 to achieve a given reflux flow and increasing the amount of nitrogen that can be recovered in line 110. The pressure of this nitrogen may, if desired, be increased by means of a compressor (not shown) driven by the expansion turbine 12.

In FIG. 2, the same reference numerals identify the same process equipment items as in FIG. 1. However the two-pass heat exchanger employed as sub-cooler 6 of FIG. 1 is replaced by a three-pass heat exchanger 16. In the arrangement illustrated in this Figure, the evaporated oxygen-rich liquid recovered from the reflux condenser 8, instead of being passed direct to the expansion turbine 12, is first passed via line 214 direct to sub-cooler 16. The temperature of the evaporated oxygen-rich liquid at the inlet to the sub-cooler is thus substantially the same as that at which it is recovered from the reflux condenser 8. In sub-cooler 16, this evaporated oxygen-rich liquid gives up cold to the oxygen-enriched column bottoms liquid in line 106 and is then passed direct to the inlet of the expansion turbine by line 216. Because of its warming in sub-cooler 16, the temperature at which this stream is supplied to the expansion engine 12 will be slightly higher, typically about 5° C. higher, than in the arrangement illustrated in FIG. 1 but can still be low enough for some condensation to occur in the expansion engine although the condensation will be less than in the arrangement of FIG. 1, e.g. about one third less. The work-expanded stream, which will be a vapour possibly containing up to 2% liquid and is now at about atmospheric pressure and a temperature not much different from that of the stream in line 214, is then passed back again through the sub-cooler in line 218 to assist in cooling the liquid in line 106 and then back through the main heat exchanger 4, as in FIG. 1.

As a result, as in the arrangement of FIG. 1, the oxygen-enriched liquid in line 106 can be sub-cooled in the sub-cooler to a lower temperature than heretofore with the result that flash in expansion valve 10 may be reduced or eliminated and accordingly the desired amount of reflux can be obtained using a smaller flow of oxygen-enriched liquid in line 106. Thus a higher recovery of nitrogen is again obtainable.

The invention is now illustrated by the following Examples.

EXAMPLE 1

Using the arrangement illustrated in FIG. 1, a high purity nitrogen stream containing 10 ppm oxygen was produced from air using the following plant conditions (in which all flow rates are expressed as $NM^3$/hour per 100 $NM^3$/hr of air supplied to the distillation column through line 102).

| STREAM | LINE | PRESSURE (Bar) | TEMPERATURE (K) | FLOW ($NM^3$/hour per 100 $NM^3$/hour of air flow in line 102) |
|---|---|---|---|---|
| Air feed to heat exchanger 4 | 102 | 5.3 | 285.0 | 100 |
| Air feed into column 2 | 102 | 5.2 | 103.2 | 100 |
| Nitrogen product after recovery from heat exchanger 4 | 112 | 4.9 | 281.0 | 48 |
| Oxygen-rich liquid leaving sub-cooler 6 | 106 | 5.1 | 89.8 | 52 |
| Turbine inlet | 114 | 2.5 | 93.5 | 52 |
| Turbine outlet | 116 | 1.4 | 87.3 | 52 |
| Waste gas leaving sub-cooler 6 | 118 | 1.3 | 97.4 | 52 |

EXAMPLE 2

Using the process illustrated in FIG. 2, a high purity nitrogen stream containing 10 ppm oxygen was produced from air using the following plant conditions (in which all flow rates are expressed in the same manner as in Example 1).

| STREAM | LINE | PRESSURE (Bar) | TEMPERATURE (K) | FLOW ($NM^3$/hour per 100 $NM^3$/hour of air flow in line 102) |
|---|---|---|---|---|
| Air feed to heat exchanger 4 | 102 | 5.3 | 285.0 | 100 |
| Air feed to column 2 | 102 | 5.2 | 103.2 | 100 |
| Nitrogen product after recovery from heat exchanger 4 | 112 | 4.9 | 281.0 | 48 |
| Oxygen-rich liquid leaving sub-cooler 16 | 106 | 5.1 | 89.9 | 52 |
| Evaporated oxygen-rich liquid leaving reflux condenser 8 | 214 | 2.5 | 93.5 | 52 |
| Turbine inlet | 216 | 2.5 | 97.4 | 52 |
| Turbine outlet | 218 | 1.4 | 87.4 | 52 |
| Waste gas leaving sub-cooler 16 | 218 | 1.3 | 97.4 | 52 |

By way of comparison, in a process according to the prior art wherein the evaporated oxygen-rich stream recovered from the reflux condenser either is first used to sub-cool the oxygen rich bottoms product from the distillation column and then is work expanded and then employed in the cooling of the feed air to the column or is first employed in the cooling of the feed air to the column then is work expanded and the work-expanded stream is employed to sub-cool the oxygen-rich bottoms product, the amount of nitrogen of similar purity that can be obtained is only about 46.5 $NM^3$ per 100 $NM^3$ of air supplied to the distillation column.

What we claim is:

1. A method for the recovery of nitrogen from air by cryogenic separation, comprising the steps of (i) cooling and distilling compressed air, from which components such as moisture and carbon dioxide which would solidify at the temperatures employed for the separation have been removed, in a single column to produce a nitrogen-rich stream overhead and an oxygen rich liquid at the bottom;

(ii) expanding said oxygen-rich liquid from the bottom to an intermediate pressure;

(iii) condensing a first portion of the overhead stream by indirect heat exchange in a reflux condenser with said intermediately expanded oxygen-rich liquid from the bottom of the column, thereby evaporating said oxygen-rich liquid and providing reflux for said distillation;

(iv) work expanding said evaporated oxygen-rich liquid from said reflux condenser, either directly after recovery from said reflux condenser or indirectly after first subcooling the oxygen-rich liquid recovered from the bottom of the column prior to step (ii), by indirect heat exchange with the evaporated-oxygen rich liquid obtained from said reflux condenser prior to said work-expansion, said evaporated oxygen-rich liquid entering said work-expanding step at an initial temperature not substantially greater than at which it was recovered from said reflux condenser, or if said evaporated-oxygen rich liquid obtained from said reflux condenser has been first passed through said subcooler, at an initial temperature not substantially greater than at which it was recovered from the subcooler;

(v) subcooling the oxygen-rich liquid recovered from the bottom of the column prior to step (ii) by indirect heat exchange in a sub-cooler with work-expanded evaporated oxygen-rich liquid from step (iv), said work-expanded evaporated oxygen-rich liquid entering said cooler at temperature not substantially greater than that to which it has been lowered by work expansion;

(vi) cooling the compressed air feed to the distillation column by indirect heat exchange with a second portion of the overhead stream from the distillation and work-expanded oxygen recovered from the subcooler in step (v).

2. A mthod as claimed in claim 1 comprising the step of work expanding the stream of evaporated oxygen-rich liquid recovered from the reflux condenser at a temperature substantially equal to that at which it was recovered from the reflux condenser and thereafter passing said stream of work expanded evaporated oxygen-rich liquid through the sub-cooler in indirect heat-exchange relationship with the oxygen-rich liquid recovered from the bottom of the column.

3. A method as claimed in claim 1 comprising the step of passing the stream of evaporated oxygen-rich liquid recovered from the reflux condenser first through the sub-cooler in indirect heat exchange relationship with the oxygen-rich liquid recovered from the bottom of the column, then work-expanding said stream of evaporated oxygen-rich liquid recovered from the reflux condenser and passing the work-expanded stream through the sub-cooler.

* * * * *